US010016887B2

(12) United States Patent
McCoy

(10) Patent No.: US 10,016,887 B2
(45) Date of Patent: Jul. 10, 2018

(54) ADAPTABLE INTEGRATED WRENCH SYSTEM

(71) Applicant: Charlie McCoy, Eagle, WI (US)

(72) Inventor: Charlie McCoy, Eagle, WI (US)

( * ) Notice: Subject to any disclaimer, the term of this patent is extended or adjusted under 35 U.S.C. 154(b) by 264 days.

(21) Appl. No.: 14/719,444

(22) Filed: May 22, 2015

(65) Prior Publication Data

US 2015/0336260 A1 Nov. 26, 2015

Related U.S. Application Data

(60) Provisional application No. 62/001,788, filed on May 22, 2014.

(51) Int. Cl.

| | |
|---|---|
| ***B25B 13/48*** | (2006.01) |
| ***B25G 1/04*** | (2006.01) |
| ***B25G 1/06*** | (2006.01) |
| ***B25B 23/00*** | (2006.01) |

(52) U.S. Cl.

CPC ..... *B25G 1/043* (2013.01); *B25B 13/481* (2013.01); *B25B 23/0021* (2013.01); *B25G 1/063* (2013.01)

(58) Field of Classification Search

CPC ..... B25G 1/043; B25G 1/063; B25B 13/481; B25B 23/0035

See application file for complete search history.

(56) References Cited

U.S. PATENT DOCUMENTS

| | | | | |
|---|---|---|---|---|
| 3,039,339 | A * | 6/1962 | Hanson | B25G 1/025 81/177.2 |
| 3,188,895 | A | 6/1965 | Jones | |
| 3,376,768 | A | 4/1968 | Fortunato | |
| 3,996,821 | A | 12/1976 | Murray | |
| 5,694,818 | A * | 12/1997 | Nickipuck | B25B 13/461 403/97 |
| 6,000,299 | A | 12/1999 | Cole | |
| 6,161,982 | A | 12/2000 | Cole | |
| 6,186,033 | B1 | 2/2001 | Faro, Sr. | |
| D473,768 | S | 4/2003 | Gilmore | |
| 7,182,000 | B1 * | 2/2007 | Dicksen | B25B 13/481 81/177.2 |
| 7,299,723 | B1 | 11/2007 | Wessel, IV | |
| 7,712,397 | B2 | 5/2010 | Hu | |
| 7,849,767 | B1 | 12/2010 | Wessel, IV | |
| 8,065,938 | B1 | 11/2011 | Kravitch | |
| 8,424,424 | B1 | 4/2013 | Kravitch | |
| 2004/0226418 | A1 * | 11/2004 | Honniball | B25B 13/481 81/177.7 |
| 2008/0307933 | A1 * | 12/2008 | Hung | B25B 13/461 81/177.8 |
| 2010/0288083 | A1 | 11/2010 | Yu | |

* cited by examiner

*Primary Examiner* — Christopher M Koehler
*Assistant Examiner* — Joel Crandall
(74) *Attorney, Agent, or Firm* — Absolute Technology Law Group, LLC

(57) ABSTRACT

An adaptable integrated wrench apparatus includes at least two segments that may be fixedly positioned at an angle relative to each other of within a range of 80 to 280 degrees to form an integrated torque-capable grasping component and at least one adapter to extend the integrated torque-capable grasping component and to receive an interchangeable wrench head.

19 Claims, 13 Drawing Sheets

ADAPTABLE INTEGRATED WRENCH SYSTEM

CROSS-REFERENCE TO RELATED APPLICATIONS

This patent application claims the benefit of U.S. Provisional Application No. 62/001,788 filed May 22, 2014. The above application is incorporated by reference herein in its entirety.

BACKGROUND OF THE INVENTION

1. Field of Invention

This invention relates to the field of tools and more specifically to a wrench with a socket and boss type connecting means.

2. Description of Related Art

Wrenches must conform to specific parts and the space available. A typical professional or consumer will have multiple wrenches of varying head configurations. In addition to carrying multiple types of wrenches, professionals and consumers often have multiple wrenches having the same wrench head with a varying body or handle shape. Despite the multiple wrenches available on the market, however, a typical professional or consumer often will not have an optimal wrench available for a specific job. Having the optimal wrench available adds efficiency to a project and relieves physical and mental stress.

Wrenches usually have a forged construction, relying on molds for manufacture. The cost associated with making various molds is one factor contributing to the lack of variation of wrenches available in the market. Wrenches also undergo treatments to ensure they withstand the pressures and forces experienced when performing a given job.

One disadvantage to needing multiple wrenches is the large storage space required. A professional may require multiple toolboxes when transporting wrenches to a job site, or may need to choose a limited number of wrenches. Often professionals need to choose a limited set of wrenches without having knowledge of the job site or what specific obstacles they will encounter.

Selecting wrenches and limiting a working collection, whether for a specific job or in whole, also limits the number of operations that a user can perform with the tools available. Wrenches are specialized tools, and require a different wrench, or wrench head, to perform each task. Workers are limited to a finite number of wrenching jobs based on the wrenches available.

A further disadvantage to needing multiple wrenches is the weight of transporting even a portion of the wrenches needed. Wrenches are usually solid to withstand the forces generated when tightening or loosening components and are therefore heavy. Carrying multiple wrenches unnecessarily increases the physical demands of an already physically intensive job.

Existing modular wrench systems known in the art have limited positions for which wrench heads may be varied. Modular system handles are constructed as single segments having a single fixed position.

It is desirable to expand and exponentially increase the operations that may be performed using one or more of the wrenches known in art.

It is further desirable to develop a wrench system that may be manufactured using alternative processes, such as polymer-based 3-D printing, for low-torque or low-force applications, or sintered metal 3-D printing for higher torque applications.

BRIEF SUMMARY OF THE INVENTION

The present invention is a wrench system including at least one interchangeable wrench head, at least one detachable, interchangeable torque segment and at least one adapter component. The detachable, interchangeable torque segment forms a planar extension and is positioned at a critical head angle relative to the interchangeable wrench head. The torque segment includes a first rounded joining component having at least one interlocking structural member and a second rounded joining component having at least one interlocking structural member. A center member separates the first and second rounded joining components. The first rounded joining component has a first radius. The second rounded joining component has a second radius. The adapter component includes an upper rounded surface having at least one interlocking structural member that conforms to at least one interlocking structural member of the torque segment. The adapter component further includes a lower rounded surface having a squared connector.

BRIEF DESCRIPTION OF SEVERAL VIEWS OF THE DRAWING(S)

FIGS. 3*a*-3*e* illustrate exemplary segments for an adaptable integrated wrench system.

FIGS. 4*a*-4*d* illustrate exemplary connectors for an adapted integrated wrench system.

FIGS. 5*a*-5*d* illustrate exemplary wrench heads for an adapted integrated wrench system.

Figure 6A:
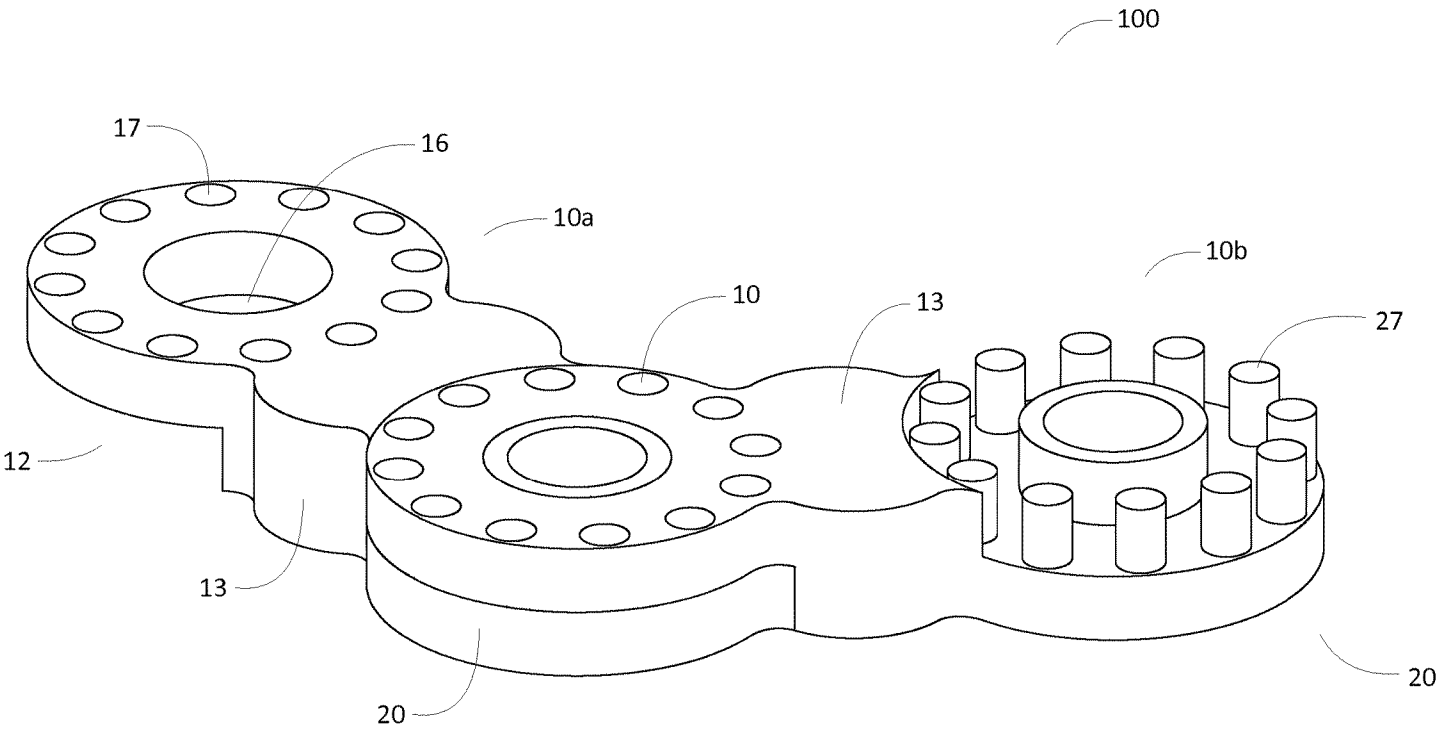
Figure 6B:
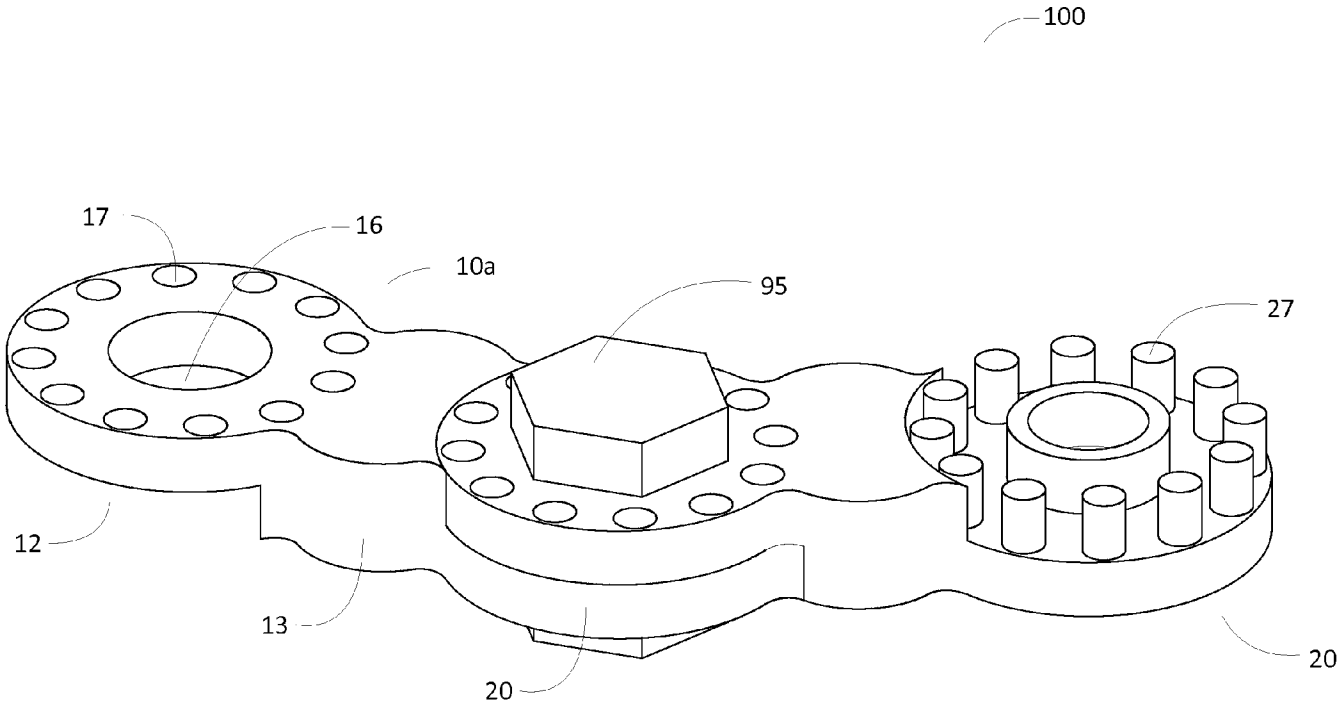

FIGS. 6*a* and 6*b* illustrate exemplary joined segments for an adaptable integrated wrench system.

Figure 7A:
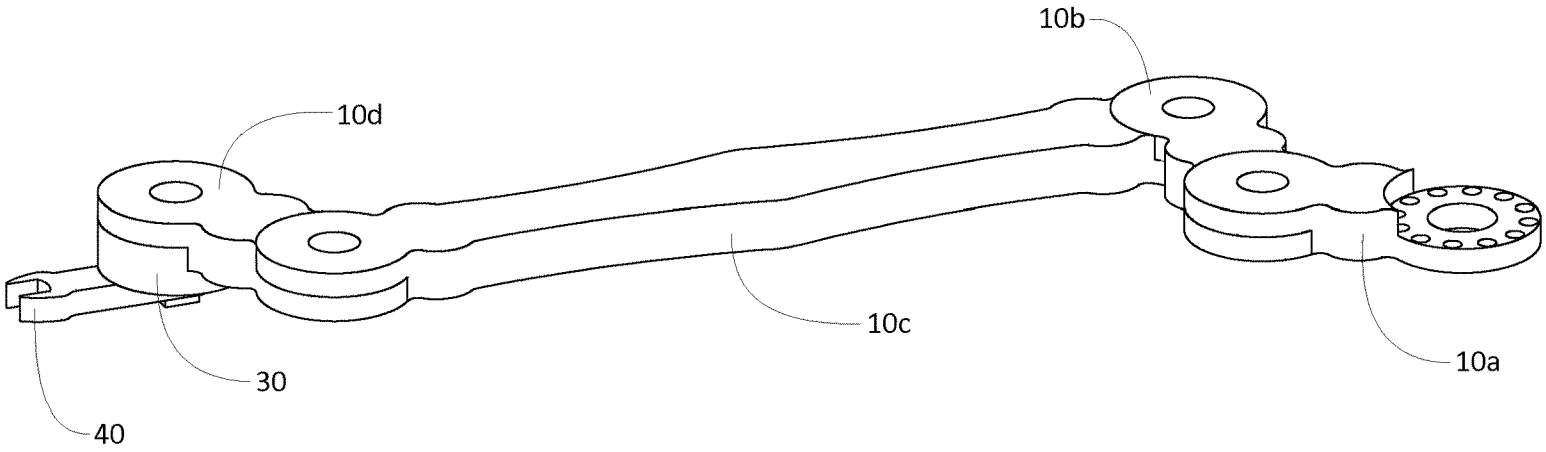
Figure 7B:
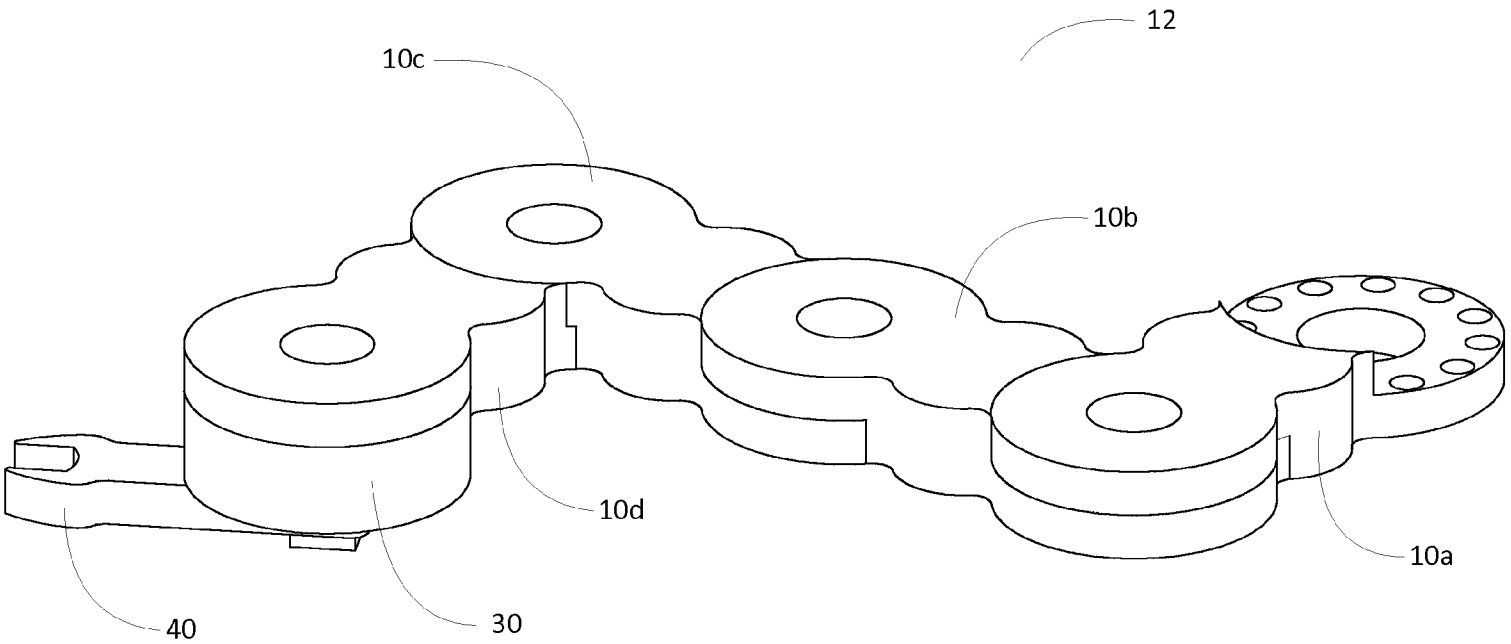

FIGS. 7*a* and 7*b* illustrate alternates assembled adaptable integrated wrench systems.

TERMS OF ART

As used herein, the term "fixedly positioned" means able to be secured, permanently or temporarily, in a position for a desired operation.

As used herein, the term "integrated torque capable component" means comprised of multiple components sufficient to withstand and apply a sufficient amount of torque force for the given wrench application.

As used herein, the term "interchangeable wrench head" means a wrench head known in the art that is selectively attachable.

As used herein, the term "Interlocking structural members" means structures, contours, protuberances or any other geometric adaptation to engage, secure or attach another component.

As used herein, the term "modular handle" means a grasping component comprised of two or more handle segments.

As used herein, the term "operatively coupled" refers to components coupled or joined in a manner to perform a desired operation.

As used herein, the term "planar" means a structure where all components are contained within a measureable top plane and a measurable bottom plane.

As used herein, the term "rounded" means circular, polygonal and other structures having at least five sides.

As used herein, the term "selectively attached" means a component that may be attached or detached.

As used herein, the term "spline" refers to a component having ridges that interlock with grooves on a second component to transfer torque.

As used herein, the term "torque segment" means a segment positioned at an angle or other measurable position relative to a wrench head that turns to exert a torque force.

As used herein, the term "wrench application" means a specific use for a wrench, including the type and size of fastener being worked with, the torque required to tighten or loosen a fastener, any obstructions around a fastener or fastening site, and any other environmental condition contributing to the decision of what type of wrench and handle are needed.

DETAILED DESCRIPTION OF THE INVENTION

Figure 1:
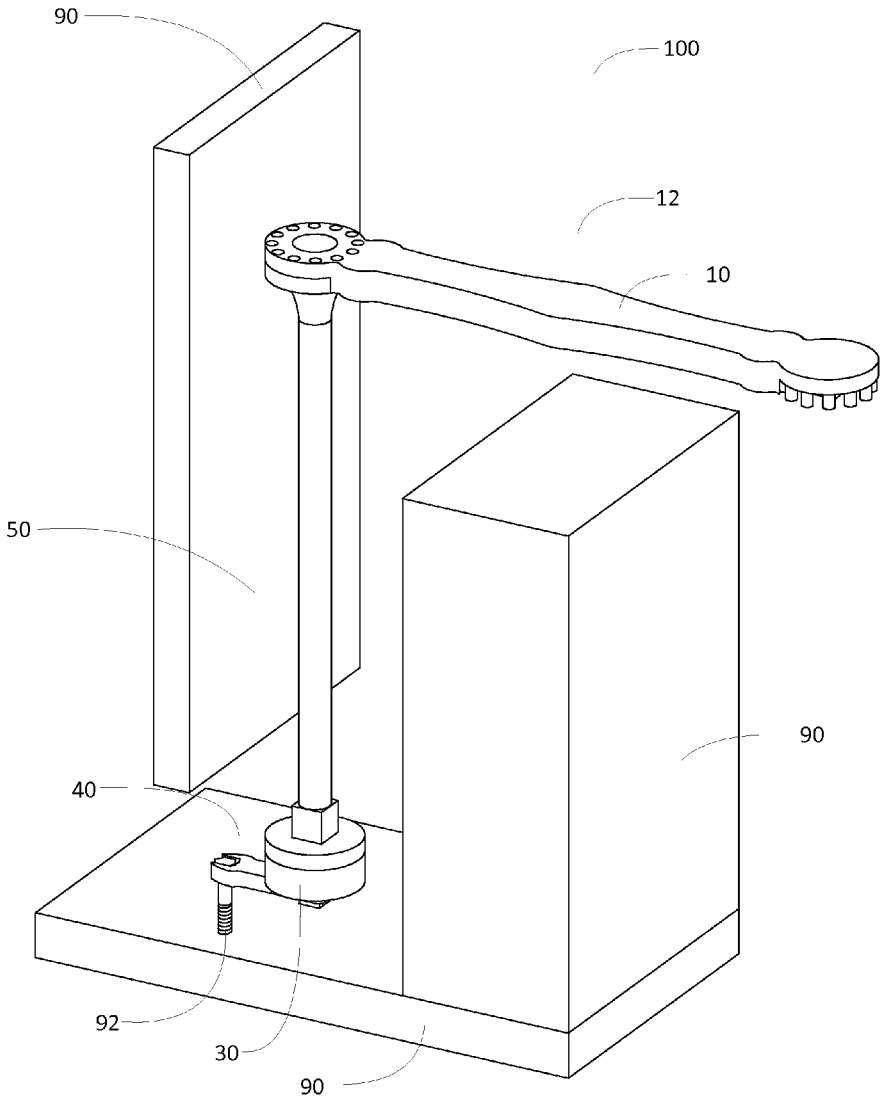
FIG. 1 illustrates an exemplary assembled adaptable integrated wrench system in use around obstructions.

FIG. 1 illustrates an exemplary assembled adaptable integrated wrench (AIWR) system 100 in use around obstructions 90. In the exemplary embodiment shown, handle 12 is comprised of a single detachable, interchangeable torque segment 10 operatively coupled with vertical extension component 50. Certain embodiments may include more than one torque segment 10. Adapter component 30 secures interchangeable wrench head 40, which is selected based on the shape of a bolt 92 or other component. By using a combination of torque segment 10 and vertical extension component 50, a user can easily build an AIWR system 100 that extends around obstructions 90 to perform the required task.

In the exemplary embodiment shown, handle 12 is comprised of torque segment 10, which acts as a graspable component. However, in other embodiments, handle 12 may be comprised of any number of torque segments 10 or a vertical extension component 50. Torque segments 10 and vertical extension components 50 may be of any length to overcome a given series of obstructions 90.

Adapter component 30 provides a structure to mount interchangeable wrench head 40, to secure to adapter component 30. In the exemplary embodiment, interchangeable wrench head 40 is a commercially available crow's foot head having a standard square opening. However, in other embodiments, interchangeable wrench head 40 may be any wrench head known in the art, including, but not limited to, a box-end wrench, an open-ended wrench, a flare-nut wrench, a ratcheting box wrench, a Saltus wrench, a spanner wrench, a striking face box wrench, an adjustable wrench, a monkey wrench, a pipe wrench, a socket wrench, a breaker bar wrench, a ratchet wrench, a torque wrench, an Allen wrench, a Bristol wrench, a Torx wrench, an alligator wrench, a cone wrench, a die wrench, a drum key, a drum wrench, a fire hydrant wrench, a curb key, a head nut wrench, a lug wrench, an oil-filter wrench, a spud wrench, a chain whip, a strap wrench, a tuning wrench, a wing nut wrench, a spark plug wrench, a combination wrench, a tube wrench, a line wrench, a speed handle, a sink wrench, a spoke wrench, a chain wrench, a tap wrench and combinations of these and other wrenches.

Figure 2:
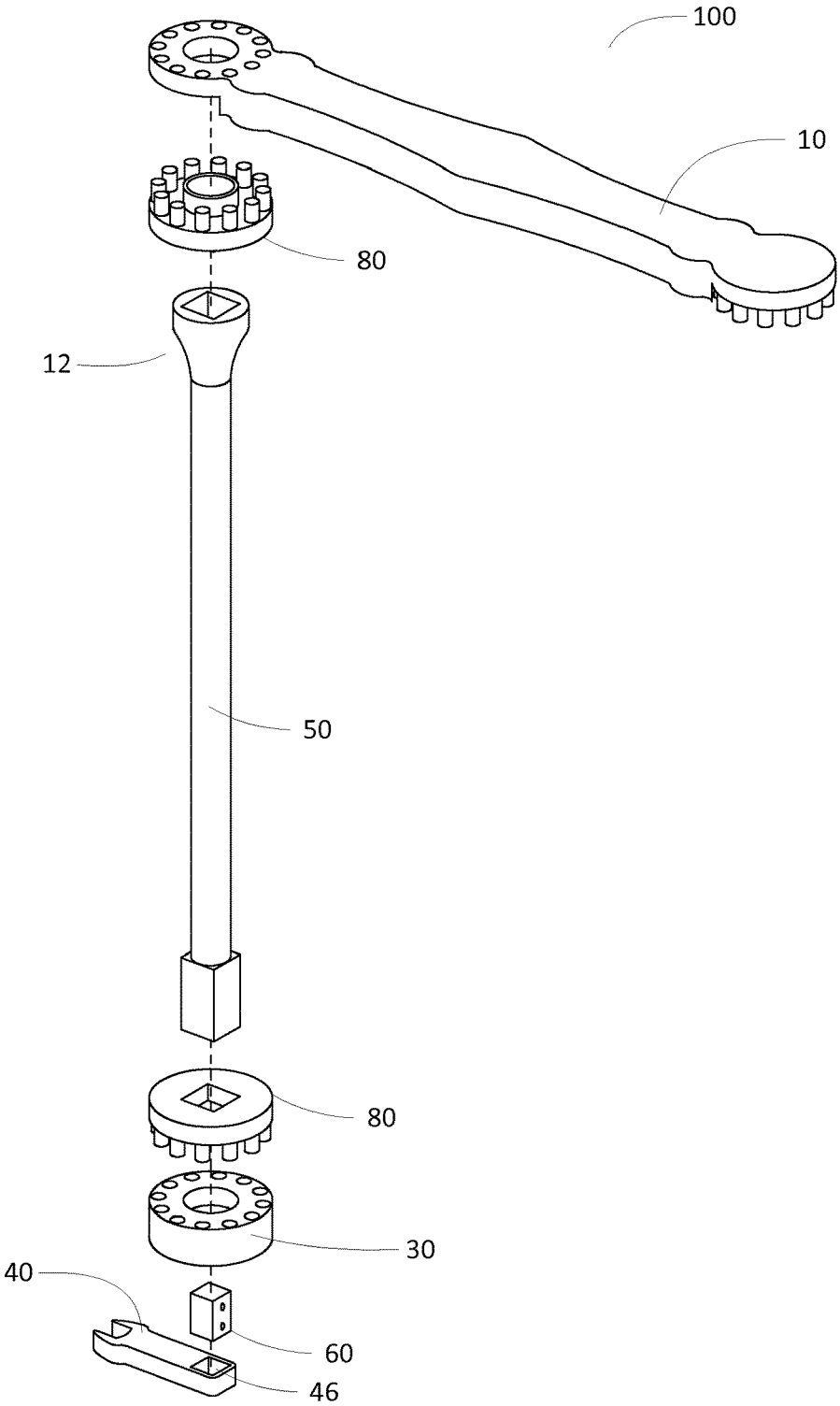
FIG. 2 illustrates an exploded view of an exemplary adaptable integrated wrench system.

FIG. 2 illustrates an exploded view of exemplary AIWR system 100. Handle 12 is comprised of torque segment 10. Vertical extension component 50 is a standard socket extension known in the art and connects to torque segment 10 and adapter component 30 with transition segments 80, which convert torque segment 10 and adapter component 30 to have squared connections corresponding to those of vertical extension component 50. In further exemplary embodiments, vertical extension component 50 may connect to adapter component 30 and torque segment 10 through any structure or combination of structures known in the art, including, but not limited to, interlocking components, pin assemblies, splines, snap on assemblies, and combinations of these and other connections.

Interchangeable wrench head 40 is a commercially available crow's foot head with a squared connection aperture 46. Interchangeable wrench head 40 selectively secures to adapter component 30 using a removable socket adapter 60. Socket adapter 60 is a standard adapter component known in the art used to secure interchangeable wrench head 40, having a female connection end, to adapter component 30, also having a female connection end. Socket adapter 60 protrudes from connection aperture 46 in interchangeable wrench head 40 for insertion into another component of AIWR system 100, thereby joining interchangeable wrench head 40 to AIWR system 100. In further exemplary embodiments, interchangeable wrench head 40 may secure to adapter component 30 using any structure or combination of structures known in the art, including, but not limited to, interlocking components, pin assemblies, splines, snap on assemblies, and combinations of these and other connections.

FIGS. 3*a*-3*e* illustrate exemplary torque segments 10 for AIWR system 100. In the exemplary embodiment shown in FIG. 3*a*, torque segment 10 is substantially planar, extending from a first rounded joining component 15 to a second rounded joining component 20. In other embodiments, torque segment 10 is curved. First rounded joining component 15 has a first radius and at least one interlocking structural member. Second rounded joining component 20 has a second radius and at least one interlocking structural member. In the exemplary embodiment shown in FIG. 3*a*, the first radius equals the second radius. The interlocking structural members of first rounded joining component 15 are central securing aperture 16 and a plurality of smaller pin receiving apertures 17. The interlocking structural members of second rounded joining component 20 are central securing protuberance 26 and a plurality of connecting pins 27.

Center member 13 separates first and second rounded joining components 15, 20. Center member 13 is planar, having at least one contoured horizontal surface conforming to a curvature of first and second rounded joining components 15, 20. The configuration of center member 13 keeps first and second rounded joining components 15, 20 in the same plane. As a result, when multiple torque segments 10 are connected, all torque segments 10 are in the same plane.

In the exemplary embodiment shown, center member 13 is longer and may function as a grasping component for handle 12. However, in other embodiments, such as in FIG. 3*b*, center member 13 may be shorter. In such embodiments, multiple torque segments 10 may create handle 12. In still other embodiments, center member 13 may be any length, width, size or configuration to provide various options to a user for AIWR system 100. Center member 13 has a length ranging from approximately one-quarter of one of the first or second radius to approximately twenty times one of the first or second radius.

In some embodiments, multiple connected torque segments 10 may act together as a modular handle and form a grasping component. In other exemplary embodiments, a designated grasping component may be provided and include grasping or ergonomic contours. In still further exemplary embodiments, multiple connected torque segments 10 that create a grasping component may join in such a way as to provide grasping contours.

Figure 3A:
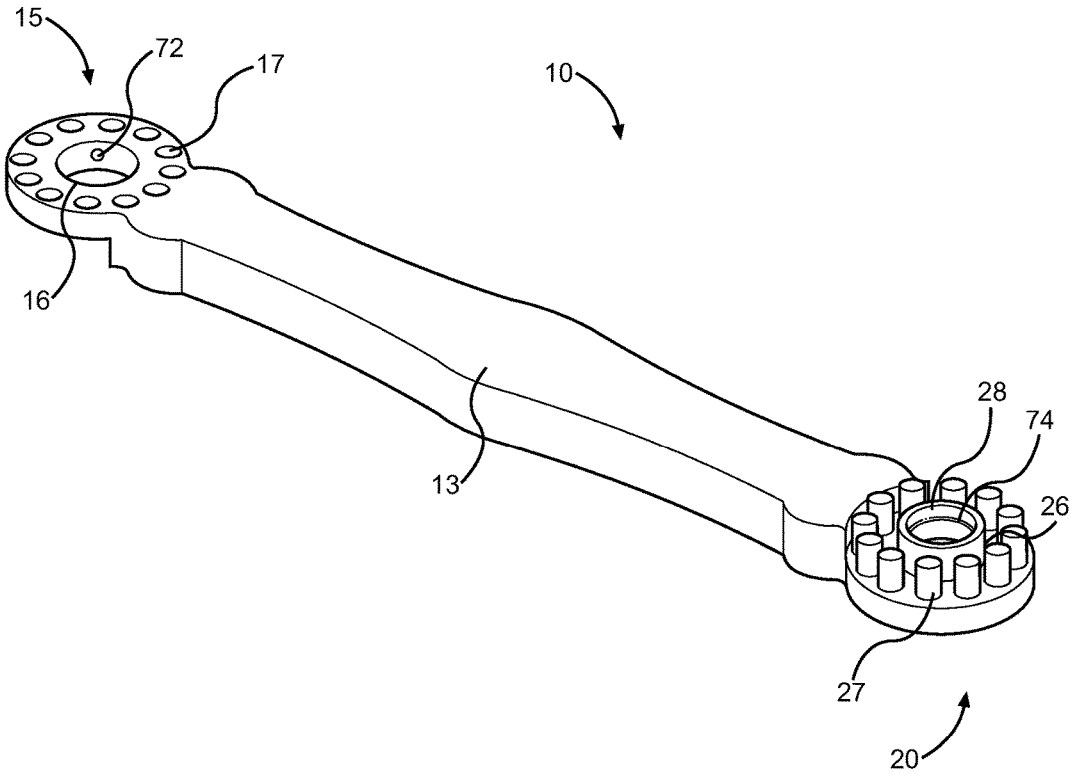

FIG. 3*a* also shows locking pin 72 with groove 74. In the exemplary embodiment shown, locking pin 72 is a spring-loaded pin disposed in the wall of central securing aperture 16. As central securing aperture 16 engages around a central securing protuberance 26, locking pin 72 moves back into central securing aperture wall until aligned with groove 74. When aligned with groove 74 in central securing protuberance 26, locking pin 72 releases into groove 74 to provide a more secure connection between torque segments 10.

In still further embodiments, torque segments 10 may include other structures or assemblies in addition to central securing aperture 16 and central securing protuberance 26 to provide a more secure connection, including, but not limited to, engaging contours, clasps, pins, bolts, spines, fasteners, magnets and combinations of these structures.

Figure 3B:
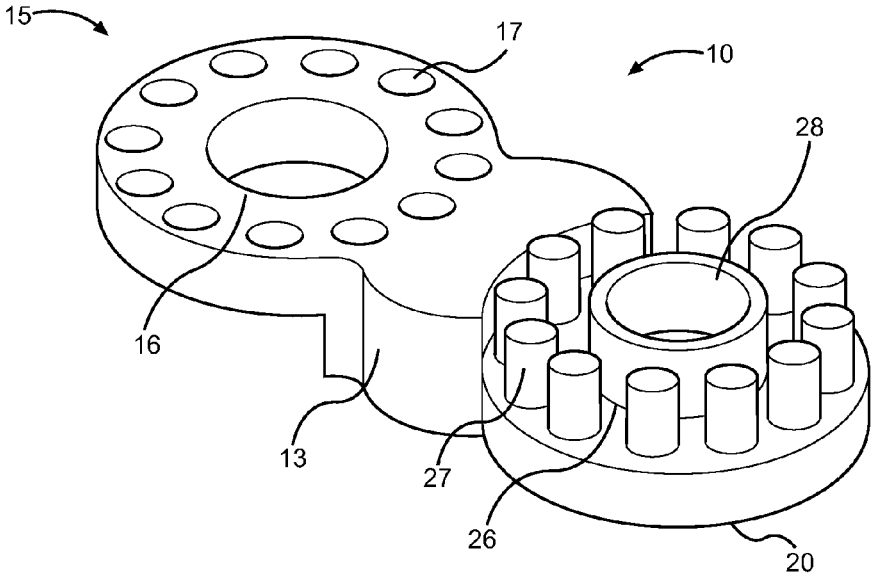

In the exemplary embodiments shown in FIGS. 3*a* and 3*b*, connecting pins 27 and central connecting protuberance 26 have a height corresponding to that of center member 13. However, one or more connecting pins 27 may extend beyond the height of center member 13. As illustrated in the alternate embodiment of FIG. 3*c*, connecting pin 27*a* is taller than the surrounding connecting pins 27 and acts as a guide pin for connecting torque segments 10 and other components of AIWR system 100. In still further alternate embodiments, central connecting protuberance 26 may also have a height greater than that of center member 13, as illustrated in embodiment of FIG. 3*c*.

Figure 3C:
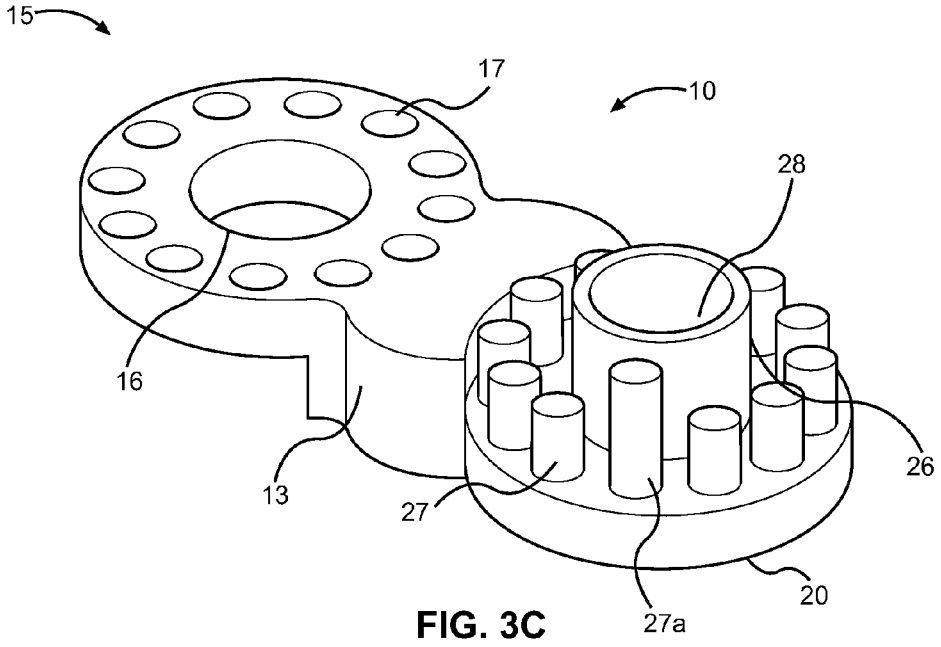

In the exemplary embodiments shown in FIGS. 3*a*-3*c*, first rounded joining component 15 has 12 symmetrically arranged pin receiving apertures 17 that correspond to the 12 symmetrically arranged connecting pins 27 of second rounded joining component 20. When joined, torque segments 10 can be placed in any orientation permitted by aligning connecting pins 27 with pin receiving apertures 17.

Because there are equally spaced 12 connecting pins 27 and 12 spaced pin receiving apertures 17, connecting pins 27 and corresponding pin receiving apertures 17 are positioned at every 30 degree interval around second and first rounded joining components 20 and 15, respectively. The positioning of torque segments 10 relative to each other is therefore limited to the positions offered by connecting pins 27 and pin receiving apertures 17.

Figure 3D:
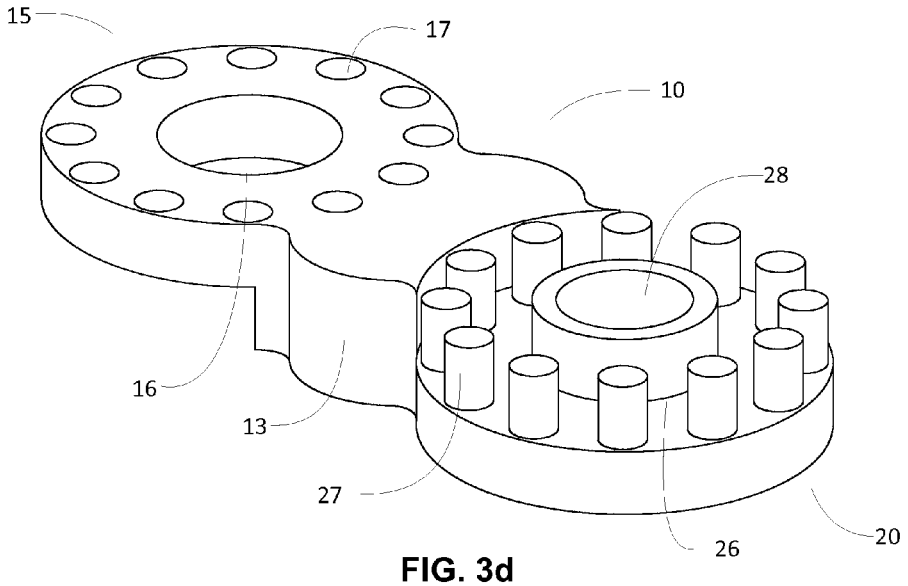

As illustrated in FIG. 3*d*, however, additional torque segments 10 may be provided with offset pin receiving apertures 17 and connecting pins 27. In the alternate embodiment shown in FIG. 3*d*, pin receiving apertures 17 and connecting pins 27 are offset approximately 15 degrees relative to the embodiments illustrated in FIGS. 3*a*-3*c*. In further exemplary embodiments, pin receiving apertures 17 and connecting pins 27 may be offset at multiples of 10, 15 or 20 degrees, or at any position within the range of 0 to 30 degrees. In still further exemplary embodiments, pin receiving apertures 17 and connecting pins 27 may have different positions on the same torque segment 10.

By providing different torque segments 10 having various center members 13 of differing lengths, as well as pin receiving apertures 17 and connecting pins 27 located at different angular positions around first and second rounded joining components 15 and 20, respectively, it is possible to create a critical angle between torque segments 10. This critical angle ranges from approximately 80 degrees to approximately 280 degrees, providing an approximately 200-degree range of positioning options. The total 200 degree range of positionability is critical in order to allow a user to appropriately position interchangeable wrench head 40 and other torque segments 10 at the desired angle relative to each other in order to achieve the desired result and perform a given wrench application. In some embodiments, however, the total positional capabilities offered by a single first torque segment 10 may be limited to between 90 and 270 degrees relative to a single second torque segment 10.

The large range of positionability offered by offset pins also allows a user to join sections to create a handle 12 optimized for a given situation. In addition to placing torque segments 10 at a critical angle, interchangeable wrench head 40 may be placed at a desired critical head angle necessary to achieve the desired objective, relative to the remainder of AIWR system 100. An optimizable handle 12 also allows creation of a desired wrench configuration both prior to reaching a job site and on site.

In the exemplary embodiments shown in FIGS. 3*a*-3*d*, connecting pins 27 are cylindrical pins projecting away from second rounded joining component 20 and having a diameter of approximately 3/16 of an inch, resulting in approximately 0.332 square inch of surface area total available to contact a second torque segment 10. By comparison, commercially available 3/8 drive offers 0.14 square inches and a 1/2 drive offers 0.25 square inches. The amount of surface area in contact along connecting pins 27 and pin receiving apertures 17, is directly proportional to the amount of force, or torque, torque segments 10 are able to withstand. AIWR system 100 can deliver 137% more torque than a 3/8 drive and 33% more than a 1/2 inch drive. Similarly, AIWR system 100 is able to withstand and apply significant amounts of torque when there is a significant amount of total surface area in contact between torque segments 10.

In the exemplary embodiments shown in FIGS. 3*a*-3*d*, connecting pins 27 have a circular cross-section with correspondingly shaped pin receiving apertures 17. In other embodiments, connecting pins 27 are may have any geometrical cross-section, such as, but not limited to elliptical, triangular, rectangular, square, trochoid, pentagonal or hexagonal. Cross-sections of connecting pins 27 (and correspondingly shaped pin receiving apertures 17) may or may not have parallel sides or symmetry.

In the exemplary embodiments shown in FIGS. 3*a*-3*d*, central securing aperture 16 has an inner diameter corresponding to the outer diameter of central securing protuberance 26. When torque segments 10 join, central securing protuberance 26 of one torque segment 10 engages the central securing aperture 16 of a second torque segment 10.

Certain embodiments of central securing protuberance 26 also contain an aperture 28 running through central securing protuberance 26. Joined torque segments 10 may further secure into a position by tightening a securing bolt 95 (shown in FIG. 6*b*) or other fastener in aperture 28. In other embodiments, a particular torque segment 10 configuration may permanently secures by welding, soldering, adhesion or otherwise permanently joining the torque segments 10 at central securing aperture 16 and central securing protuberance 26.

In still further exemplary embodiments, torque segments 10 may include other structures or assemblies in addition to central securing aperture 16 and central securing protuberance 26 to provide a more secure connection, including, but not limited to, engaging contours, clasps, pins, bolts, spines, fasteners, magnets and combinations of these structures.

Figure 3E:
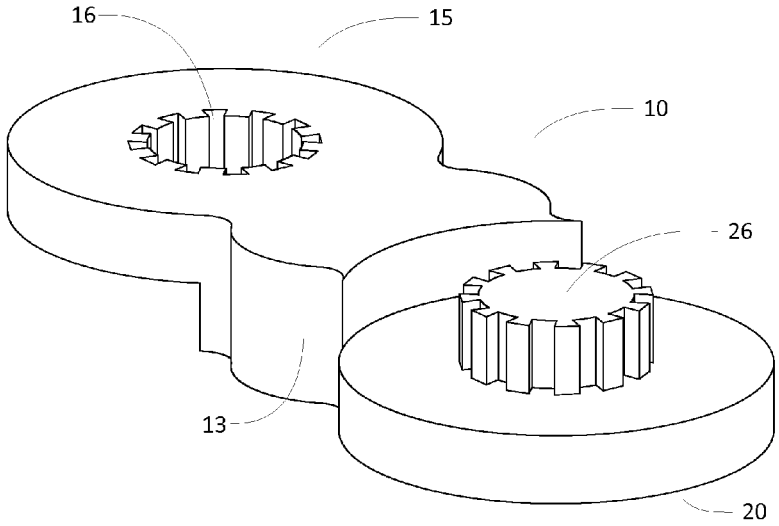

FIG. 3*e* illustrates a torque segment 10 having splined interlocking structural members. In the embodiment shown, central securing aperture 16 has 12 dovetailed channels and central securing protuberance 26 has 12 dovetailed protuberances to create the interlocking splines. The embodiment illustrated in FIG. 3*e* omits pin receiving apertures 17 and connecting pins 27. Torque segments 10 join using only splined central securing aperture 16 and splined central securing protuberance 26. However, in further embodiments, splines may be used in combination with pin receiving apertures 17 and connecting pins 27 on the same torque segment 10.

Like pin receiving apertures 17 and connecting pins 27, offset splines may accommodate various orientations of torque segments 10 relative to each other. Further, for a single torque segment 10, the position of splines on a central securing aperture 16 may differ from the position of splines on a central securing protuberance 26.

In the alternate embodiment illustrated, interactions between a plurality of corresponding dovetailed channels and dovetailed protuberances create splines. In further embodiments, splines may be any configuration or shape of selectively attachable mating male and female structures. However, in still further embodiments, splines may be any structure or configuration known in the art. Splined connections in a three-dimensional plane may also connect torque segments 10 without requiring vertical extension component 50.

As illustrated in FIGS. 3*a*-3*e*, interlocking structural members (e.g., splines of central securing aperture 16 and central securing protuberance 26, pin receiving apertures 17 and connecting pins 27) are symmetrically arranged in sets of 12. In further exemplary embodiments, more or fewer interlocking components may be used. Increased interlocking components results in AIWR system 100 able to withstand, and therefore apply, more force because of the increased contacting surface area between torque segments 10.

While the interlocking structural members illustrated in FIGS. 3*a*-3*e* have a primarily circular arrangement, in further exemplary embodiments interlocking structural members may arranged in other configurations, such as linear, square, oval or any other symmetric arrangement. In still further embodiments, transition segments 80 may be used to convert, or transition, a torque segment 10 having a circular arrangement to having a different arrangement of interlocking structural members.

In some embodiments, torque segments 10 are configured such that first rounded joining component 15 is female and second rounded joining component 20 is male. In other embodiments, first rounded joining component 15 may be male, while second rounded joining component 20 is female. In still further exemplary embodiments, torque segments 10 may include two female rounded joining components or two male rounded joining components. Further embodiments provide additional transition segments 80 to serve as male/female adapters.

FIGS. 4*a* through 4*d* illustrate exemplary adapter components 30 for AIWR system 100. Adapter components 30 each have a first rounded surface 32 containing interlocking structural members adapted to connect to torque segment 10 or transition segment 80, and a second rounded surface 31 containing interlocking structural members adapted to connect to interchangeable wrench head 40.

Figure 4A:
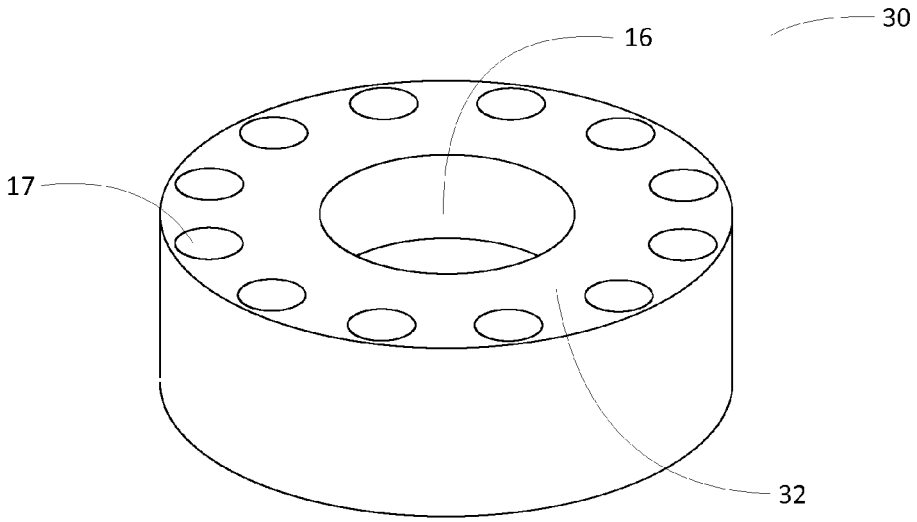
Figure 4B:
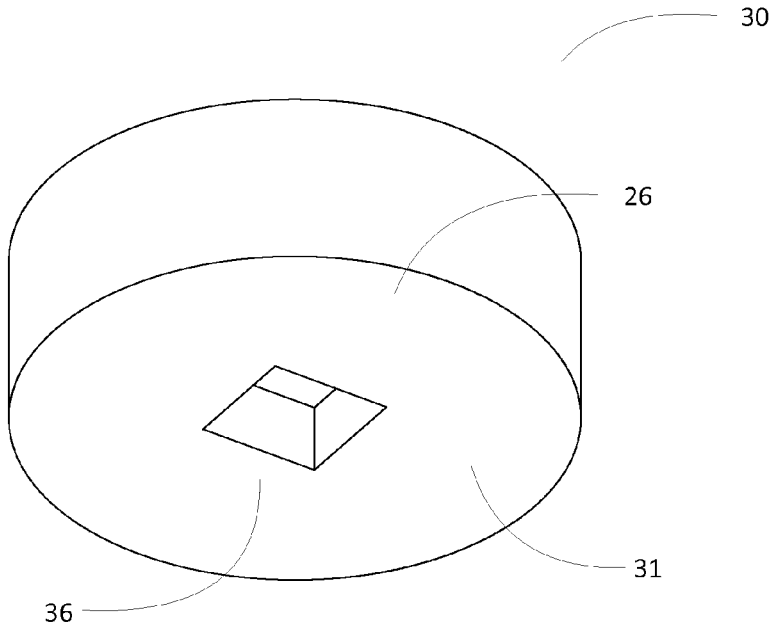
Figure 4C:
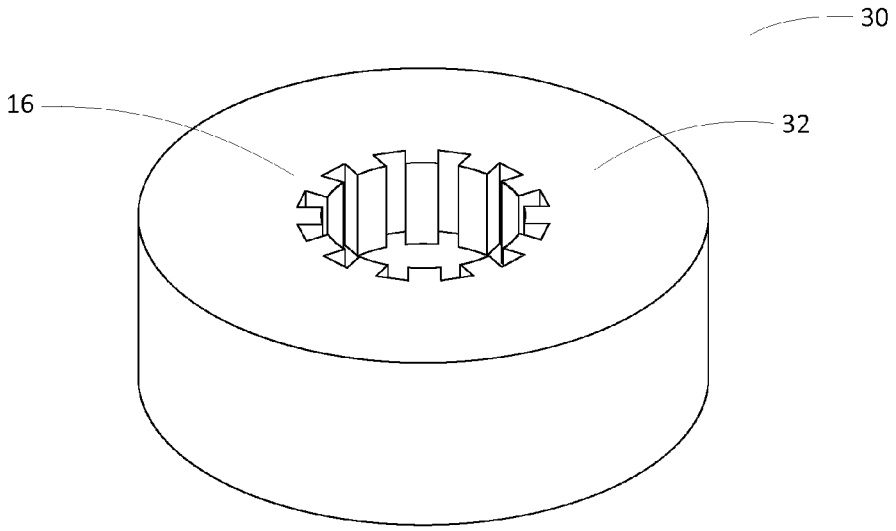
Figure 4D:
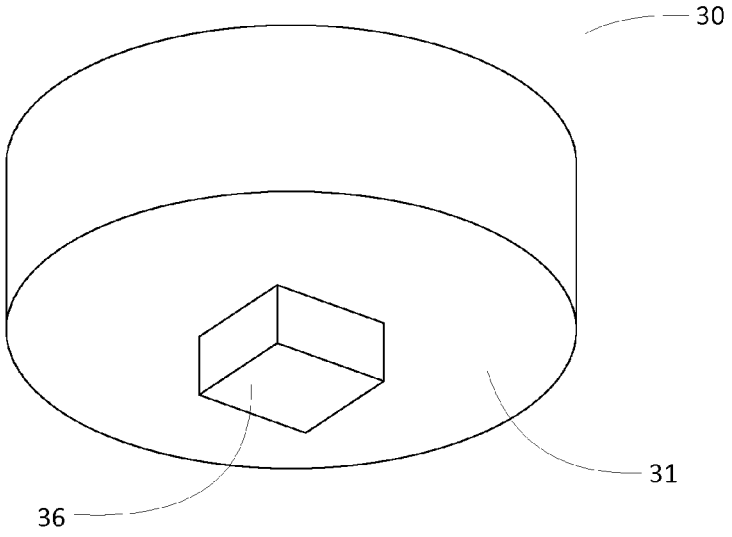
Figure 5A:
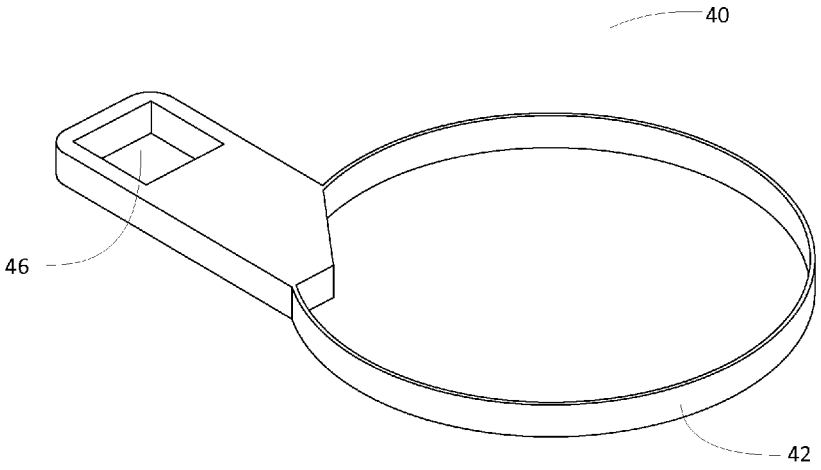
Figure 5B:
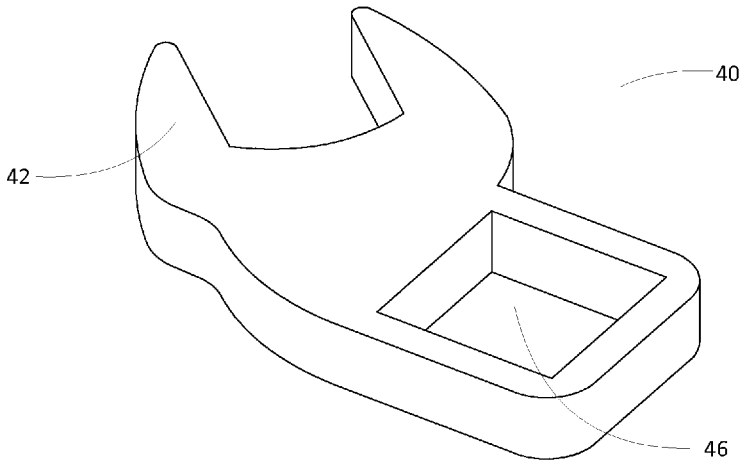
Figure 5C:
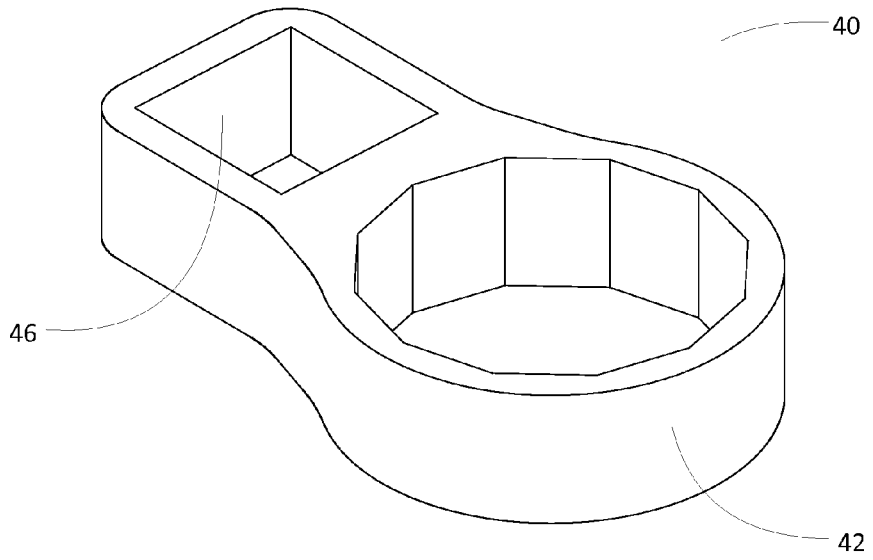
Figure 5D:
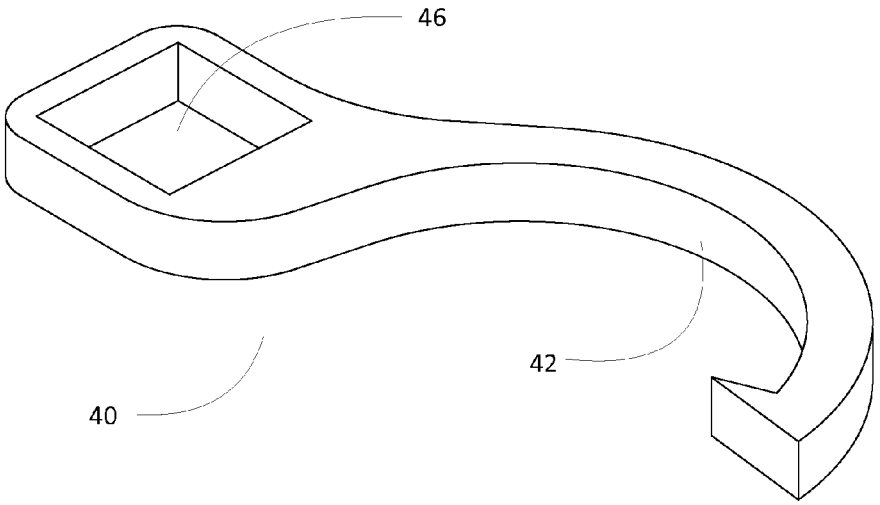

In the exemplary embodiment shown in FIGS. 4*a* and 4*b*, first rounded surface 32 has interlocking structural members of central securing aperture 16 with pin receiving apertures 17. In the exemplary embodiment shown in FIGS. 4*c* and 4*d*, first rounded surface 32 has interlocking structural members of central securing aperture 16 with splines. These interlocking structural members correspond to interlocking structural members of segment 10.

In the embodiments shown in FIGS. 4*a* through 4*d*, both first rounded surfaces 32 are female connections. Using a female connection at first rounded surface 32 (e.g., central securing aperture 16 with pin receiving apertures 17 or central securing aperture 16 with splines) allows users of AIWR system 100 to easily manufacture adapter components 30 using a punch, rather than having to machine male interlocking structural components.

For example, a user may require an AIWR system 100 with adapter components 30 with very specific dimensions. The user may simply punch central securing aperture 16 with pin receiving apertures 17 or central securing aperture 16 with splines to connect any interchangeable wrench head 40 to an existing AIWR system 100 without having to purchase additional components. A user can also create a specific interchangeable wrench head 40 with female interlocking structural components to connect interchangeable wrench head 40 directly to a torque segment 10. However, in further embodiments, first rounded surface 32 may contain male interlocking structures (e.g., central securing protuberance 26 with or without splines and/or connecting pins 27).

As illustrated in FIGS. 4*a* through 4*d*, second rounded surface 31 of adapter component 30 has a structural interlocking component that is a squared connector 36. As illustrated in FIG. 4*a* squared connector 36 is a square aperture designed to be used with existing square socket connections known in the art, while in FIG. 4*c* has a squared connector 36 which is a square protuberance designed to directly secure interchangeable wrench head 40.

Squared connector 36 allows adapter components 30 to be compatible with existing and commercially available wrench heads and connections known in the art. Socket adapters 60, are squared peg-like structures known in the art and may be used to attach interchangeable wrench head 40, having a squared aperture, to squared aperture 36 of adapter component 30. Squared connector 36 may be of a size known in the art, such as ¼", ⅜", ½", ¼", or 1". However, in further exemplary embodiments, squared connector 36 may be any shape or size known in the art to secure a wrench head.

In further embodiments, however, AIWR system 100 may include adapter components 30 and interchangeable wrench heads 40 using a specific or proprietary connection structure of any shape or configuration designed to secure wrench heads and transfer torque.

In the embodiments shown in FIGS. 4*a* through 4*d*, a thickness separates first and second rounded surfaces 32, 31. The thickness of adapter component 30 may depend on whether squared connector 36 is a protuberance or aperture. When squared connector 36 is an aperture, adapter component 30 must be thick enough that a socket adapter 60 can securely engage squared connector 36.

FIGS. 5*a*-5*d* illustrate exemplary interchangeable wrench heads 40 for AIWR system 100. Each exemplary interchangeable wrench head 40 illustrated in FIGS. 5*a*-5*d* includes a wrench component 42 and a connection aperture 46. As illustrated, connection aperture 46 is square and allows interchangeable wrench head 40 to join to an adapter component 30 containing a squared connector 36 that is a protuberance without any additional structures, or to a squared connector 36 that is an aperture with the help of a socket adapter 60. Interchangeable wrench heads 40 having square connection apertures 46 are commercially available and known in the art. However, in further embodiments, interchangeable wrench heads 40 (as well as corresponding adapter components 30) may be specifically manufactured to securely connect using any structure or combination of structures known in the art.

In the embodiments shown FIGS. 5*a*-5*d*, wrench component 42 is a strap wrench, striking face box wrench, box-end wrench, and spanner wrench, respectively. In further embodiments, wrench component 42 may be any wrench known in the art.

FIGS. 6*a* and 6*b* illustrate exemplary joined torque segments 10*a*, 10*b* for AIWR system 100. The exemplary embodiments shown in FIGS. 6*a* and 6*b* both include two torque segments 10*a*, 10*b*, with torque segments 10*a*, 10*b* connected at different angles in each figure. In the exemplary embodiment shown in FIG. 6*b*, securing bolt 95 provides additional stabilization in securing segments 10*a*, 10*b*.

As illustrated in FIGS. 6*a* and 6*b*, torque segments 10*a*, 10*b* each include first and second rounded joining components 15, 20, respectively, with second rounded joining component 20 of torque segment 10*a* engaging first rounded joining component 15 of torque segment 10*b*. Interlocking structural components (e.g., connecting pins 27 and central securing protuberance 26) of torque segment 10*a* engage interlocking structural components (e.g. pin receiving apertures 17 and central securing aperture 16) of torque segment 10*b*.

FIGS. 7*a* and 7*b* illustrate exemplary assembled AIWR systems 100. AIWR system 100 as illustrated in FIG. 7*a* includes four torque segments 10*a*-10*d*, one adapter component 30 and one interchangeable wrench head 40. Torque segments 10*a*-10*d* have center members 13 of different lengths and are joined at different angles to provide a custom modular handle 12 to meet a specific job function and overcome obstructions.

In the exemplary embodiment shown in FIG. 7*a*, AIWR system 100 is designed to be gripped at torque segments 10*a* and 10*b*, but, in further exemplary embodiments, may be gripped using any of torque segments 10*a*-10*d*. In the exemplary embodiment shown in FIG. 7*b*, handle 12 is comprised entirely of shorter torque segments 10*a*-10*d*. Arranging shorter torque segments 10*a*-10*d* at alternating angles creates a handle 12 having an ergonomic grasping portion.

When used in conjunction with vertical extension components 50, AIWR system 100 may create a wrench conforming to any application required. Components of AIWR system 100, including torque segments 10, adapter components 30, interchangeable wrench heads 40, vertical extension components 50, and transition segments 80 may have multiple configurations to create modular and versatile wrenches.

In the exemplary embodiments described, components of AIWR system 100 are machined from metal and sized for use with standard fasteners, such as bolts, used and known in the art. However, the size and material of AIWR system 100 components may vary depending on a specific application. For example, components of AIWR system 100 may be generated using a 3-D printer or additive machining for low-torque application. Components may be scaled down for micro applications or scaled up to handle larger or high-torque jobs. AIWR system 100 components may also be made out of non-magnetic material when use of magnetic materials would be problematic (e.g., repairing an MRI machine).

In still further embodiments, multiple variations of torque segments 10, adapter components 30, interchangeable wrench heads 40, vertical extension components 50 and transition segments 80 have a specifically selected and manufactured material, size, and thickness, as well as any necessary specific treatment, based on the torque necessary to complete a given job.

It will be understood that many additional changes in the details, materials, procedures and arrangement of parts, which have been herein described and illustrated to explain the nature of the invention, may be made by those skilled in the art within the principle and scope of the invention as expressed in the appended claims.

It should be further understood that the drawings are not necessarily to scale; instead, emphasis has been placed upon illustrating the principles of the invention. Moreover, the terms "substantially" or "approximately" as used herein may be applied to modify any quantitative representation that could permissibly vary without resulting in a change in the basic function to which it is related.

What is claimed is:

1. A wrench system comprised of:

at least one interchangeable wrench head;

a plurality of torque segments which are detachable and interchangeable;

wherein each of said plurality of torque segments is positioned at a critical head angle of approximately 80 to 280 degrees relative to an interchangeable wrench head;

wherein each of said plurality of torque segments is a single piece which has surfaces on two different planar levels, wherein a first planar level includes a center member and a first rounded joining component having a first interlocking structural member and a second planar level includes said center member and a second rounded joining component having a second interlocking structural member, and wherein said first and second rounded joining components are separated by said center member;

wherein said center member of each of said plurality of torque segments has a curved recess configured to receive a rounded joining component of another of said plurality of torque segments to form a singular planar surface when two or more of said plurality of torque segments are joined; and wherein said first interlocking structural member is not retractable with said first rounded joining component and said second interlocking structural member is not retractable with said second rounded joining component;

wherein said first rounded joining component has a first radius and said second rounded joining component has a second radius; and at least one adapter component comprising an upper rounded surface having said at least one first interlocking structural member which conforms to said at least one second interlocking structural member of said at least one detachable, interchangeable torque segment, said at least one adapter component further comprising a lower rounded surface having a squared connector.

2. The apparatus of claim 1 wherein said interlocking structural members are selected from the group consisting of a central securing aperture, a splined central securing aperture, a central securing protuberance, a splined central securing protuberance, a plurality of connecting pins, a plurality of connecting pin apertures, a locking pin, a groove and combinations thereof.

3. The apparatus of claim 1 wherein said center member has a length ranging from approximately one-quarter of one of said first and second radius to approximately twenty times one of said first and second radius.

4. The apparatus of claim 1 wherein said first and second radius are equal.

5. The apparatus of claim 1 wherein said at least one first interlocking structural member of said first rounded joining component comprises a central securing aperture and said at least one second interlocking structural member of said second rounded joining component comprises a central securing protuberance.

6. The apparatus of claim 5 wherein said at least one first interlocking structural member of said first rounded joining component further comprises a plurality of connecting pin apertures and said at least one second interlocking structural member of said second rounded joining component further comprises a plurality of connecting pins.

7. The apparatus of claim 6 wherein at least one of said connecting pins extends beyond a plane created by said torque segment.

8. The apparatus of claim 5 wherein said central securing aperture and said central securing protuberance are splined.

9. The apparatus of claim 1 wherein said center member is planar having at least one contoured horizontal surface conforming to a curvature of said first and second rounded joining components.

10. The apparatus of claim 1 wherein said at least one detachable wrench head is selected from the group consisting of a box-end wrench, an open-ended wrench, a flare-nut wrench, a ratcheting box wrench, a flex head wrench, a spanner wrench, a striking face box wrench, an adjustable wrench, a monkey wrench, a pipe wrench, a socket wrench, a breaker bar wrench, a ratchet wrench, a torque wrench, a multiple spline driver wrench, a hex wrench, an alligator wrench, a cone wrench, a die wrench, a drum key, a drum wrench, a fire hydrant wrench, a curb key, a head nut wrench, a lug wrench, an oil-filter wrench, a spud wrench, a chain whip, a strap wrench, a tuning wrench, a wing nut wrench, a spark plug wrench, a combination wrench, a tube wrench, a line wrench, a speed handle, a sink wrench, a spoke wrench, a chain wrench, a tap wrench and combinations thereof.

11. The apparatus of claim 1 wherein said at least one detachable, interchangeable torque segment is curved.

12. The apparatus of claim 1 wherein said at least one detachable, interchangeable torque segment may be combined with at least one other detachable, interchangeable torque segment to form a critical angle.

13. The apparatus of claim 12 wherein said critical angle ranges from approximately 80 degrees to approximately 280 degrees.

14. The apparatus of claim 1 wherein said at least one first interlocking structural member of said first rounded joining component comprises a plurality of connecting pins and said at least one second interlocking structural member of said second rounded joining component comprises a plurality of connecting pins.

15. The apparatus of claim 1 wherein said at least one first interlocking structural member of said first rounded joining component comprises a plurality of pin receiving apertures and said at least one second interlocking structural member of said second rounded joining component comprises a plurality of pin receiving apertures.

16. The apparatus of claim 1 wherein said at least one first interlocking structural member of said first rounded joining component comprises a plurality of pin receiving apertures and said at least one second interlocking structural member of said second rounded joining component comprises a plurality of connecting pins.

17. The apparatus of claim 1 wherein said at least one first interlocking structural member of said first rounded joining component comprises a plurality of connecting pins and said at least one second interlocking structural member of said second rounded joining component comprises a plurality of pin receiving apertures.

18. The apparatus of claim 1 further comprising a removable socket adapter, wherein said socket adapter protrudes from a connection aperture in said at least one interchangeable wrench head.

19. The apparatus of claim 1 further comprising at least one vertical extension component located between said at least one adapter component and said at least one detachable, interchangeable torque segment.

* * * * *